US005722656A

United States Patent [19]

Dickerson

[11] Patent Number: 5,722,656

[45] Date of Patent: Mar. 3, 1998

[54] MACHINE TO PLAY GAME WITH ROLLING BALLS AND DISPENSE THE BALLS AS PRIZES

[76] Inventor: Lyle G. Dickerson, 345 W. 17th St., Idaho Falls, Id. 83402

[21] Appl. No.: 742,656

[22] Filed: Nov. 4, 1996

[51] Int. Cl.[6] ..... A63F 7/02

[52] U.S. Cl. ..... 273/118 R; 273/119 R; 273/121 R

[58] Field of Search ..... 273/108, 118 R, 273/118 A, 119 R, 119 A, 121 R, 121 A, 122 R, 122 A, 123 R, 123 A, 124 R, 124 A, 125 R, 125 A

[56] References Cited

U.S. PATENT DOCUMENTS

| | | | |
|---|---|---|---|
| 677,905 | 7/1901 | Tribble | 273/119 R |
| 2,003,349 | 6/1935 | Dumble | 273/121 A |
| 2,093,293 | 9/1937 | Stoner et al. | 273/121 A |
| 2,926,915 | 3/1960 | Johns | 273/118 A |
| 3,476,391 | 11/1969 | Fejko | 273/124 R |
| 5,131,655 | 7/1992 | Ugawa | 273/121 B |
| 5,137,278 | 8/1992 | Schilling et al. | 273/119 A X |
| 5,149,093 | 9/1992 | Schilling et al. | 273/119 A X |
| 5,516,104 | 5/1996 | Takemoto et al. | 273/119 R X |

OTHER PUBLICATIONS

Brochure cover published by Nationwide Games, 7 Church Lane, Baltimore, MD showing "bubble gum game machine" called Drop Zone.

Article in newspaper bearing legend "Monday, Jul. 22, 1996, The Enterprise" headed New firm to begin manufacturing interactive gumball machines.

*Primary Examiner*—Raleigh W. Chiu

[57] ABSTRACT

Machine to dispense spherical or near-spherical objects such as gumballs or rubber balls. A reservoir holds the balls and a sloping playfield is provided. After a coin is inserted a ball from the reservoir is dropped onto the playfield. A player can then use flippers to try to hit a target with the ball before the ball falls through one of the holes which the playfield contains. If this happens the ball is dispensed and the player no longer has an opportunity to hit the target. If the player is able to hit the target with the ball that ball is dispensed. At the same time, a second ball is dispensed as a prize.

8 Claims, 9 Drawing Sheets

FIG. 4
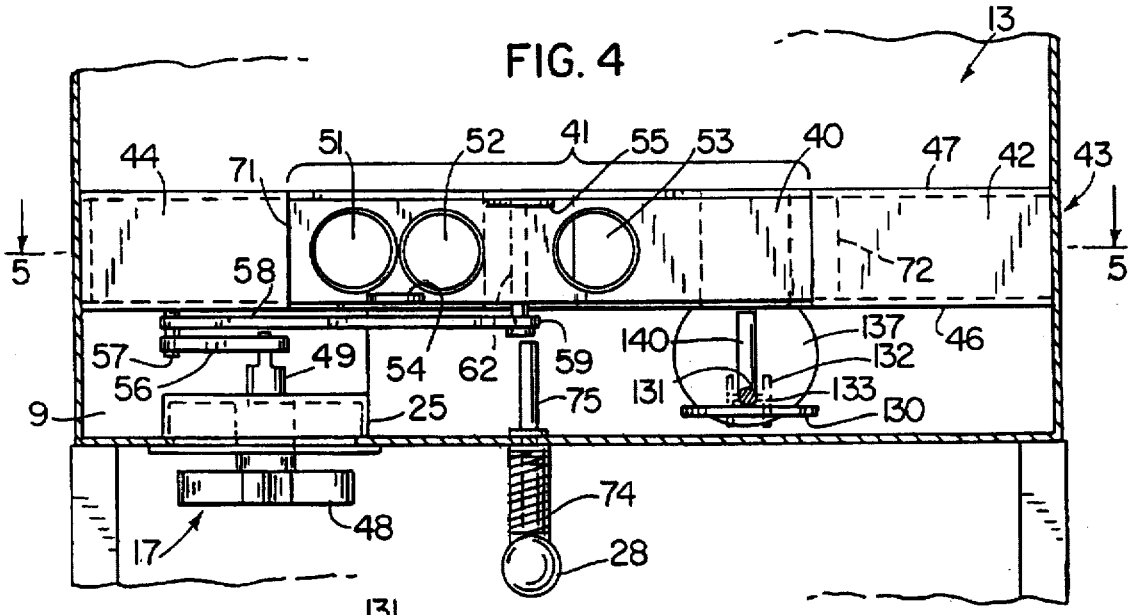
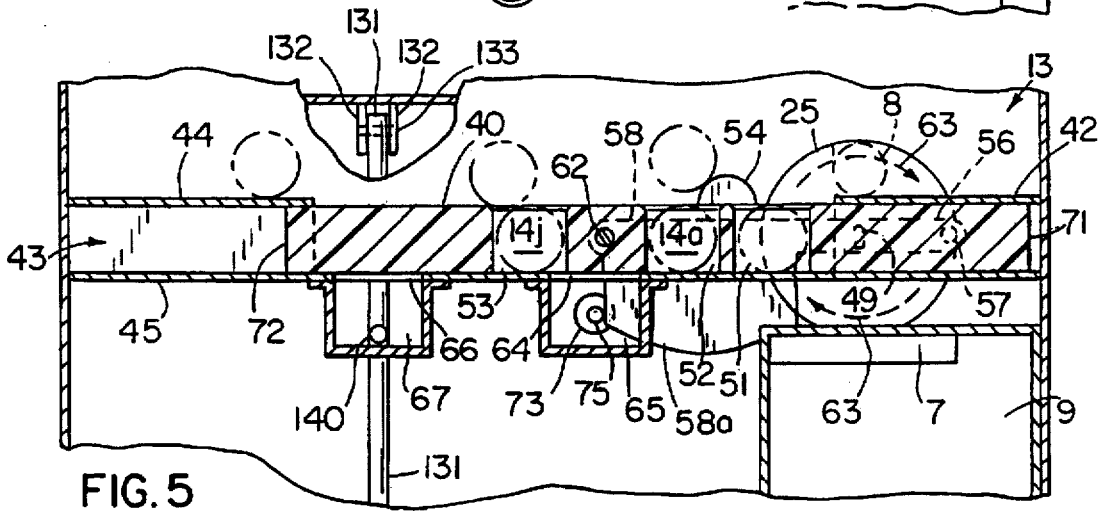
FIG. 5
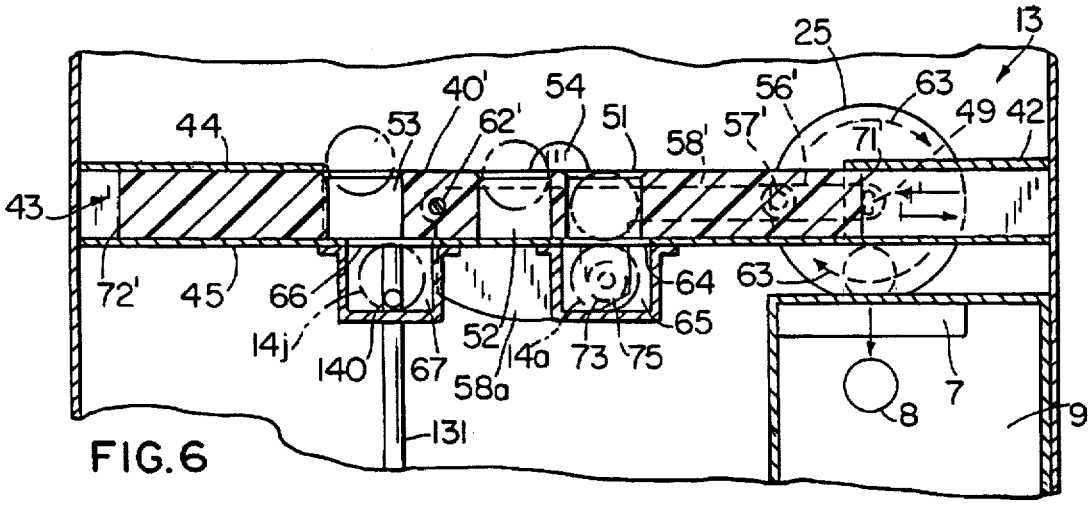
FIG. 6

FIG. 12
FIG. 10
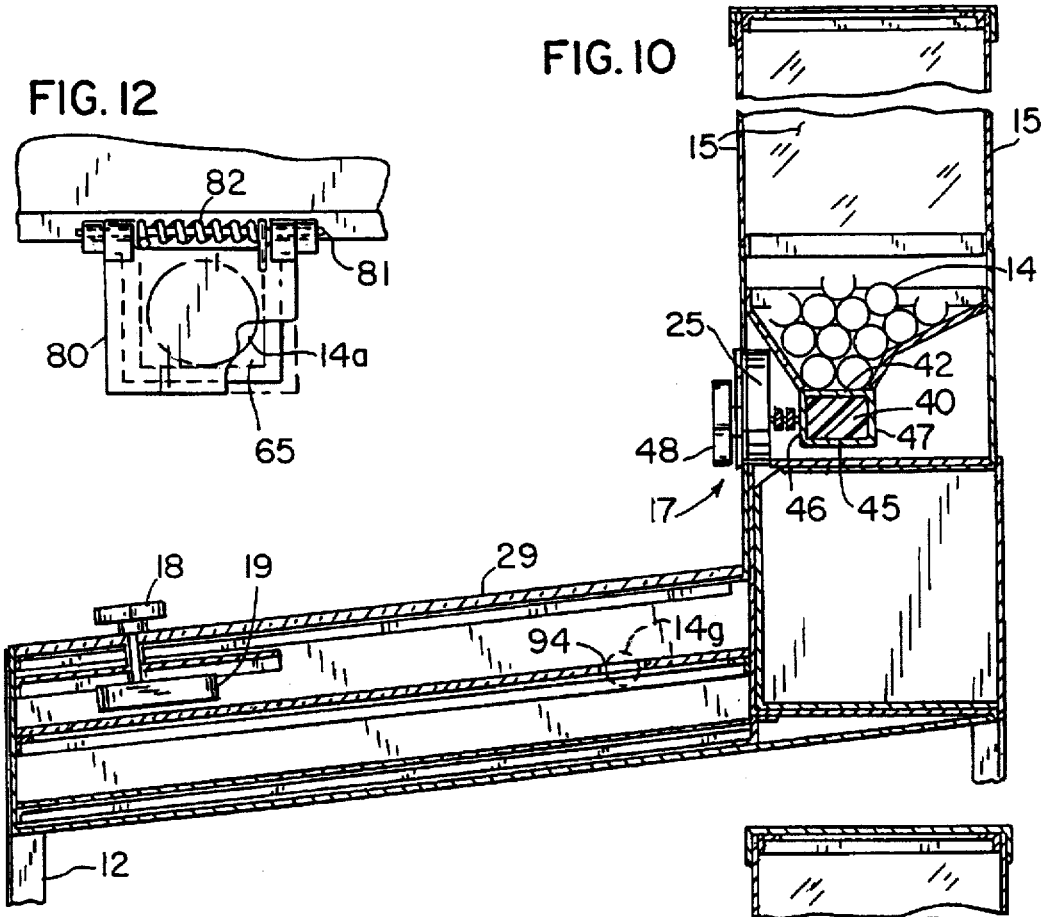
FIG. 13
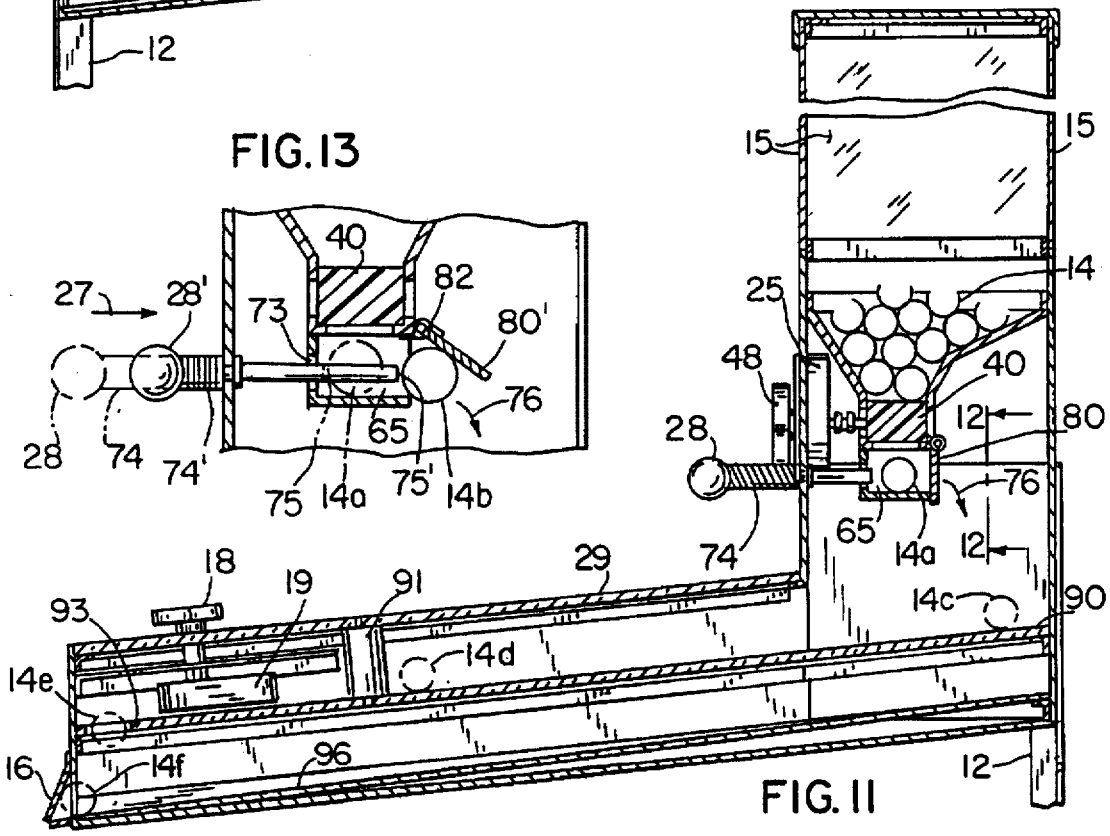
FIG. 11

FIG. 21
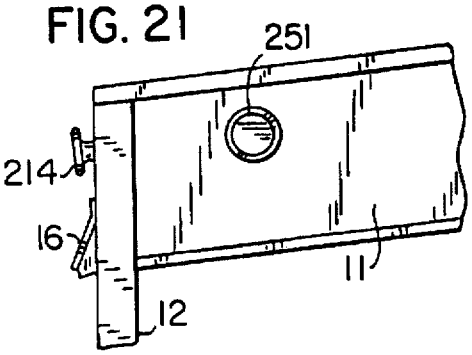
FIG. 24
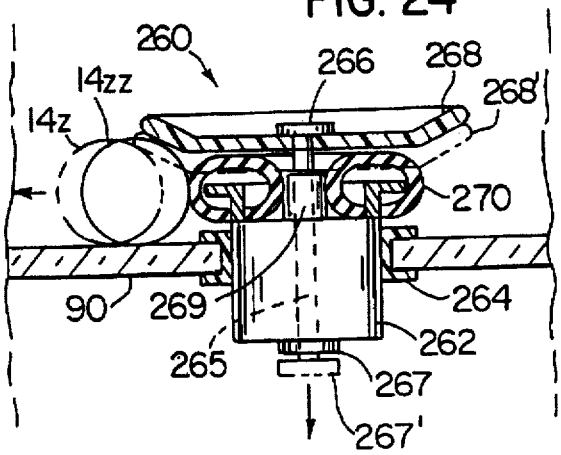
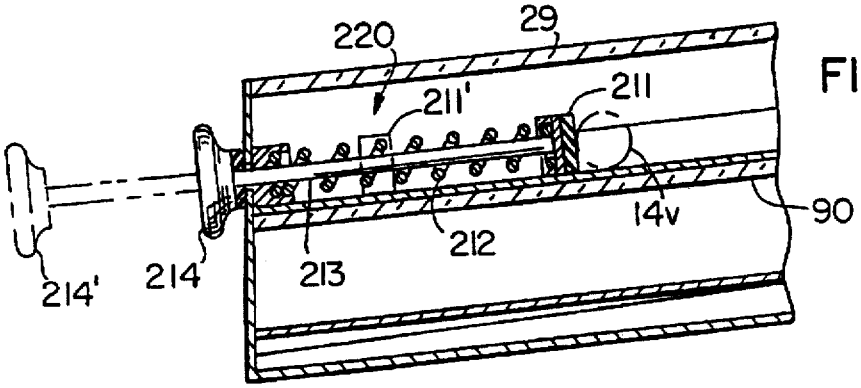
FIG. 25
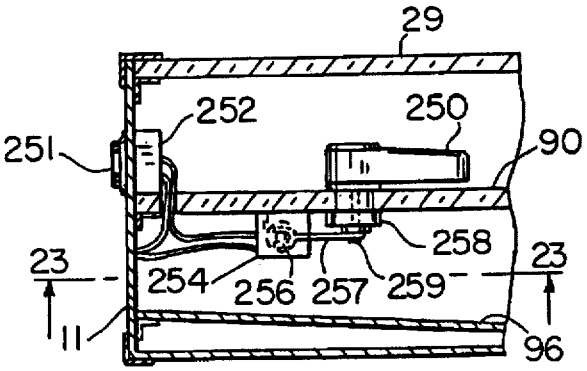
FIG. 22
FIG. 23
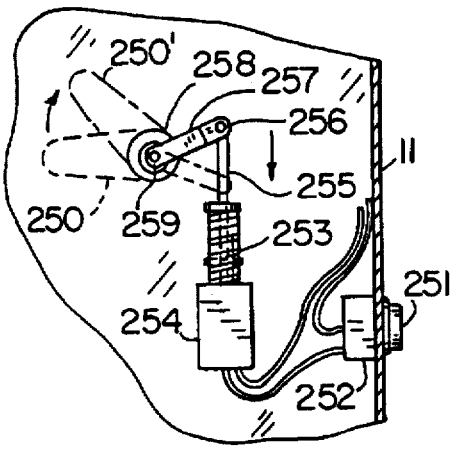

MACHINE TO PLAY GAME WITH ROLLING BALLS AND DISPENSE THE BALLS AS PRIZES

TECHNICAL FIELD

The invention relates to a machine to dispense spherical or near-spherical objects such as gumballs and specifically to such a machine wherein means is provided to play a game with one of the objects prior to its being dispensed and to dispense some of said objects as prizes for success in playing the game.

BACKGROUND OF THE INVENTION

The following patents show a combination of a vending device with an amusement device or disclose devices which have both an amusement function and a dispensing function. In many the amusement feature involves playing a game and in some the game is played with a rolling ball on a sloping playfield.

But the patents and other disclosures discussed below do not show the object which is awarded as a prize for ability in playing the game as being first used as a projectile in playing the game and especially not as a rolling ball type of projectile in the playing of the game. None shows the vending of the playing pieces., either as the principal object to be achieved by the user in response to insertion of a coin or as prizes or both.

U.S. Pat. No. 5,149,093 issued Sep. 22, 1992 to Schilling et al.

U.S. Pat. No. 2,003,349 issued Nov. 23, 1933 to Dumble

U.S. Pat. No. 3,476,391 issued Nov. 4, 1969 to Fejko

U.S. Pat. No. 2,045,084 issued Jan. 30, 1936 to Moloney

U.S. Pat. No. 1,700,541 issued Jan. 29,1976 to Mills

U.S. Pat. No. 3,953,027 issued Apr. 27, 1976 to Katzman et al.

U.S. Pat. No. 2,926,915 issued Mar. 1, 1960 to Johns

U.S. Pat. No. 2,092,286 issued Sep. 7, 1937 to Melnick et al.

U.S. Pat. No. 2,022,445 issued Nov. 26, 1935 to Vogel et al.

U.S. Pat. No. 2,012,502 issued Aug. 27, 1935 to Fey

U.S. Pat. No. 1,040,077 issued Oct. 1, 1912 to Whiting

The Schilling patent shows vending of trading cards in response to achieving certain scores in playing pinball and the Dumble patent shows vending of a mint candy (column 1, line 49) in response to inserting a coin combined with making the pinball playfield available to the player but the mint candy is not dispensed in response to achieving some pinball score nor is another candy available until another coin is inserted.

Fejko shows a combination of a first reciprocating slide, a second reciprocating slide, dispensing of gumballs, playing of marbles and throwing of dice to achieve a dice score but the various functions are essentially independent.

Moloney shows issuance of "tickets" in response to achieving certain pinball results. These may be exchanged with the manager of the venue where the machine is located for the right to play additional games.

Mills shows vending of a candy ball in response to inserting a coin, whereupon a ball is released to fall through a field of pins (pachinko type) and if the player is able to catch the falling ball with a moveable cup, another candy ball is dispensed.

Katzman shows the dispensing of tokens from a bin in a toy truck by operation of a reciprocating slide having a pocket to receive one token at a time. The dispensing is not in response to the introduction of a coin but only in response to a pulling the slide manually and is also not in response to any game-playing action. The amusement or game function lies in aligning tokens with previously dealt cards.

Johns shows a skee ball machine which dispenses tickets in response to achievement of certain results. The tickets can be exchanged for free games or merchandise (or money).

Melnick shows a machine which throws dice when a pinball play is begun, to indicate the score the player should achieve. A player who succeeds in achieving the score may receive from the manager of the venue where the machine is located either a prize of merchandise or money or the right to play additional games.

Vogel describes an "amusement device" associated with a vending machine which is operated when a coin is placed in the machine to obtain merchandise. It is a drum carrying colored figures or designs which rotates "at a high rate of speed and for a considerable length of time . . . "

Fey shows a pinball machine in which the player may be rewarded for achieving certain results by the opening of a door to make an article of merchandise available to the player.

Whiting shows a combination of vending an article and actuating a weighing mechanism. The operation of the weighing apparatus may be considered to be for amusement but there is no provision for playing a rolling ball game.

U.S. Pat. No. 957,472 issued Mar. 10, 1910 to Mitchell shows the mechanical throwing of a projectile. The projectile which is thrown is a second projectile which is thrown only in response to a target being struck by a first projectile which is a rolling projectile. Neither projectile is dispensed.

U.S. Pat. No. 5,370,391 issued Dec. 6, 1994 to Hilzendeger et al. shows a game of chance utilizing spherical objects as playing pieces. This patent, like all the others cited, does not show the vending of the playing pieces., either as the principal object to be achieved by the user in response to insertion of a coin or as prizes or both, as here.

It has been reported in a newspaper published in Salt Lake City, Utah, on Jul. 22, 1996, that two men (Brent H. Van Allen and Jaydee Anderson) have developed a machine wherein a gumball comes down a track from a reservoir and then "goes in a merry-go-round, up an elevator, into a Ferris wheel, around another track and into a cannon" and that the player can then "shoot the gumball at a target" and that there is "a clown going back and forth in front of the target to keep you from hitting it" and that "if you miss the clown and hit the target you get another gumball free." It appears that the gumball passes through the air to hit the target and that there is no playfield and that therefor the ball does not roll on any playfield. It is also stated that "the men have been developing the machine since mid-January" whereas the development of the instant invention began earlier.

In a brochure published by Nationwide Games, Inc., 7 Church Lane, Baltimore, Md., a picture is shown on the cover of a "bubble gum game machine" which is called a "Drop Zone". In response to insertion of a coin a gumball is released onto a pair of sticks which extend toward the operator from beneath the reservoir across a depressed area. Near the operator the sticks rest on a lateral shelf and have portions which stick out toward the operator from the shelf and are provided with knobs on their ends. The sticks are inferentially pivoted at their other ends which cannot be seen underneath the reservoir. The operator may grasp the knobs to move the knobbed ends of the sticks together and apart to cause the ball to roll on the sticks toward the operator and back again and finally to cause it to drop at a selected point when the sticks are moved apart sufficiently. The depressed area is provided with a plurality of targets through one of which the ball may pass when dropped from the sticks.

Within the brochure it is stated that "the customer, for a quarter, gets these three things: 1. An opportunity to play an exciting new game 2. A chance to win something in the store that they are going to purchase anyway 3. A gumball every time".

None of the patents or other disclosures discussed above suggests or teaches the claimed invention.

SUMMARY OF THE INVENTION

The apparatus of the invention comprises a source such as a bin or reservoir to hold spherical or near-spherical objects such as gumballs or the like, the reservoir being in upwardly spaced relation to a sloping playfield onto which the objects can be dropped. Means are provided to receive coins and to separate one of the objects from the number contained in the reservoir and cause it to be dropped onto the playfield in response to receiving a coin. Flippers are provided to make it possible to attempt to drive the object into contact with a target which in turn is disposed to cause another of the same objects contained in the reservoir to be dispensed as a prize, in addition to the dispensing of the first object with which the game was played, which occurs when the first object hits the target or falls into or enters one of several passages before striking the target. Embodiments may be provided in which more than one of the objects may be provided as prizes.

All of such objects which are best described as objects chosen from the group consisting of spherical and near-spherical objects will be often referred to hereinafter as "balls" and it is to be understood that by this term it is meant to include all spherical and near-spherical objects which may be conceived for use in the device provided that they are suitable for being awarded as prizes. Thus the large steel balls which are conventionally used in pinball machines are not to be considered as being included and neither are the small steel balls conventionally used in pachinko machines. Balls which are suitable for use in the machine of the invention include preferably gumballs or balls which have an exterior shell comprising relatively hard or strong plastic with a small article contained in the interior which may be a trinket or toy. Such an article may be a miniature flag, a small toy truck, a paper card or scroll bearing indicia such as a poem or a verse from the bible, or the like. Other balls which may be suitably used in the machine may be balls of hard candy or rubber balls or other balls of a firm elastic material.

BRIEF DESCRIPTION OF THE DRAWINGS

FIG. 4 is a fragmentary sectional plan view taken on line 4—4 in FIG. 1 which shows the mechanism below the reservoir which is disposed to separate objects from those in the reservoir and make them available to be dropped onto the playfield or to be dispensed as prizes.

FIG. 5 is a cross sectional elevation from the rear of the mechanism of FIG. 4 taken on lines 5—5 in FIG.4.

FIG. 6 is a view from the same aspect as FIG. 5 but with the mechanism in a different position.

FIG. 10 is a cross sectional elevation taken on lines 10—10 in FIG. 7.

FIG. 11 is a cross sectional elevation taken on lines 11—11 in FIG. 7.

FIG. 12 is a rear elevation of a portion of the device taken from the point of view of lines 12—12 in FIG. 11.

FIG. 13 is a cross sectional view of that portion of the device shown in FIG. 12.

FIG. 21 is a side elevation of a portion of the embodiment of FIG. 18 taken from the point of view of lines 21—21 in FIG. 18.

FIG. 22 is a cross sectional elevation taken on lines 20—20 in FIG. 18.

FIG. 23 is a view from below taken on lines 23—23 in FIG.22.

FIG. 24 is a cross sectional view taken on lines 24—24 in FIG. 18.

FIG. 25 is a cross sectional view taken on lines 25—25 in FIG. 18.

DETAILED DESCRIPTION OF THE PREFERRED EMBODIMENTS

Figure 1:
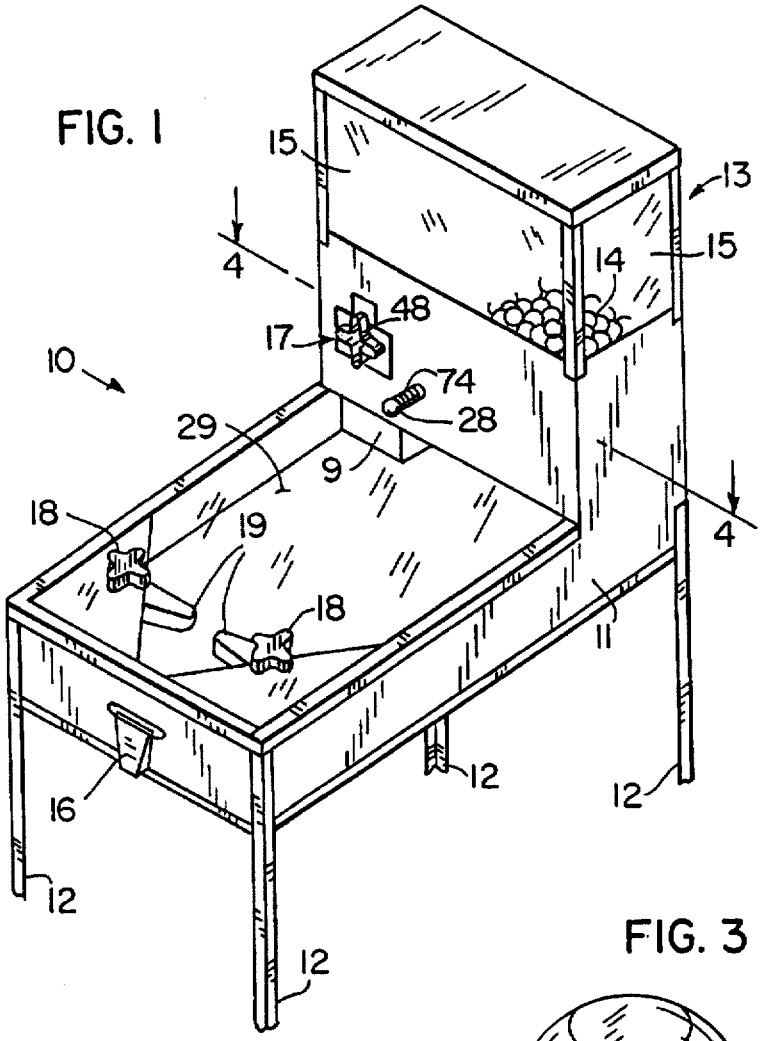
FIG. 1 is a perspective view of one embodiment.

Referring now to FIGS. 1, 7, 8 and 9, the main body 11 of the device indicated generally as 10 may be supported on legs 12 and be provided with a reservoir or tank 13 which may hold a plurality of spherical or near-spherical objects such as gumballs 14. As alternatives to gumballs, objects such as balls of hard candy, capsules which contain miniature toys or flags or decorations, rubber balls or the like may be provided, all of which are suitable for being awarded as prizes.

As mentioned above, such objects which are best described as objects chosen from the class consisting of spherical and near-spherical objects will be generally referred to hereinafter as "balls" and it is to be understood that by this term it is meant to include all spherical and near-spherical objects which may be conceived for use in the device provided that they are suitable for being awarded as prizes.

The sides 15 of reservoir 13 may be transparent. To dispense a ball it is introduced to the area behind cover 16 which may then be lifted by a user to obtain the ball, after first completing several previous steps.

Coin receipt and initiation of operation of the machine is the function of the mechanism indicated generally as 17 which may comprise recessed coin slot 21 (FIG. 8) to receive a coin thereinto.

Knob 28 is provided to actuate the mechanism which causes a ball to drop onto playfield 90. Knobs 18 are provided to operate flippers 19 seen through transparent cover 29.

Figure 2:
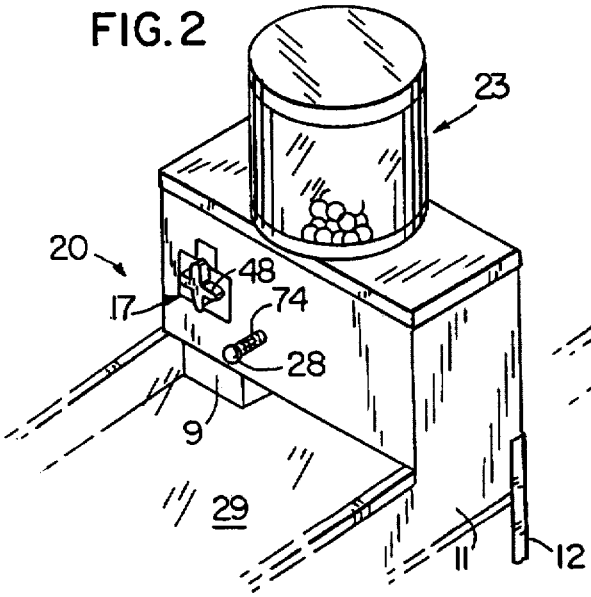
FIG. 2 is a similar view of a modification of the embodiment of FIG. 1.
Figure 3:
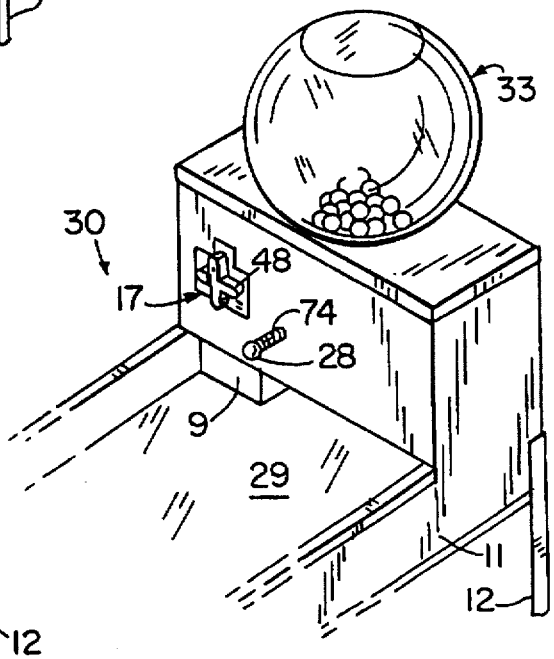
FIG. 3 is a similar view of another modification of the embodiment of FIG. 1.
Figure 7:
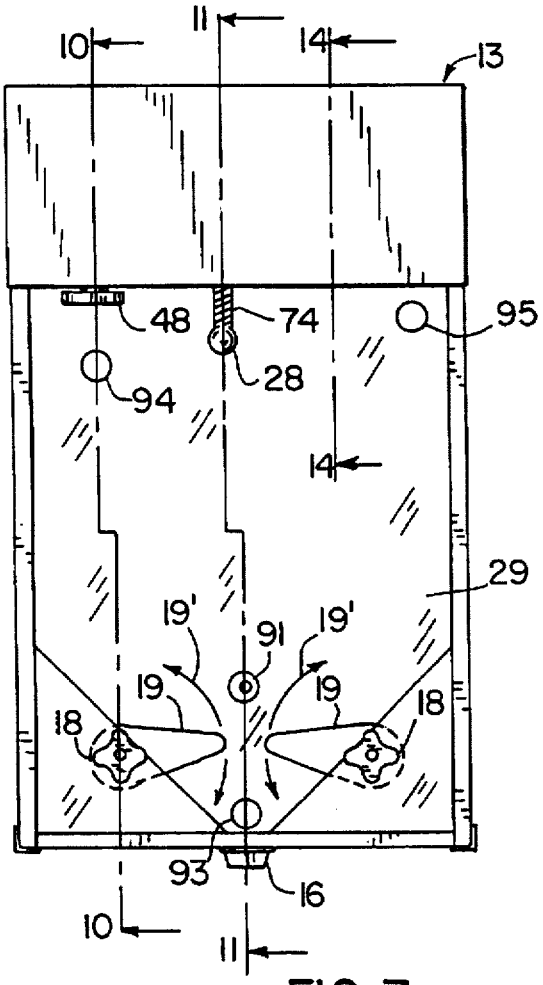
FIG. 7 is a plan view of the embodiment of FIG. 1.
Figure 8:
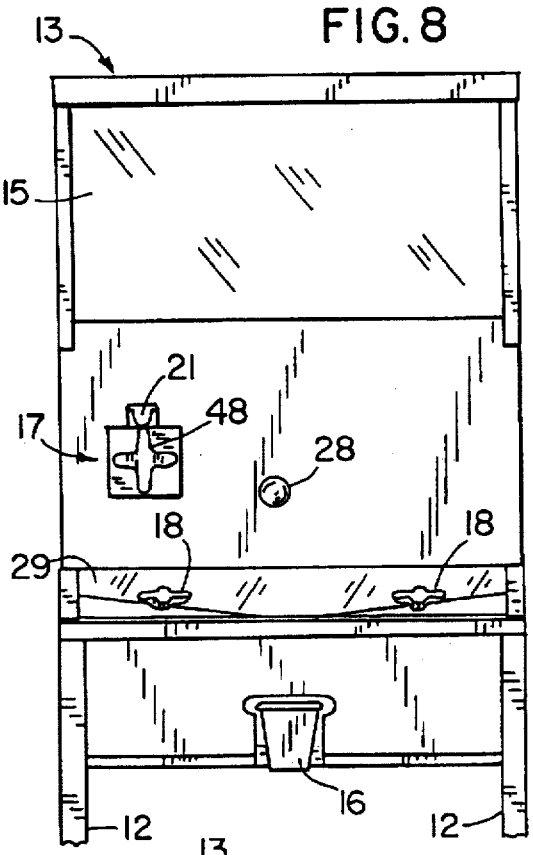
FIG. 8 is a front elevation of the embodiment of FIG. 1.
Figure 9:
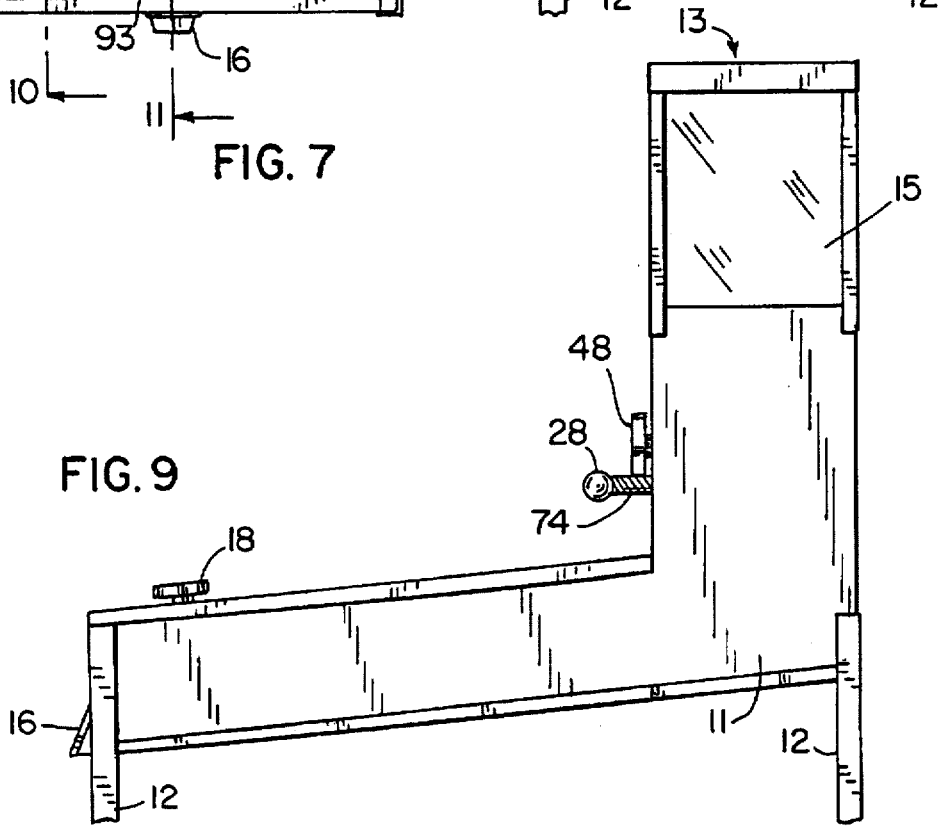
FIG. 9 is a side elevation of the same embodiment.

In FIGS. 2 and 3 are shown modifications 20 and 30 of the device of FIG. 1. Reservoir 23 which is generally cylindrical in shape or reservoir 33 which is generally spherical in shape is provided in place of rectangular reservoir 13. All or any portion of the walls of reservoirs 23 and 33 may be transparent.

Referring now to FIGS. 4, 5 and 6 there is shown a slide bar 40 of plastic slidably received in a rectangular channel or tube indicated generally as 43 which may be defined by a bottom portion 45, a discontinuous top comprising end portions 42 and 44 which are parts of the bottom of reservoir 13 and are separated by opening 41 in the bottom of reservoir 13 and by side portions 46 and 47. The opening 41 allows balls 14 to communicate therethrough with the top of slide bar 40 and the cylindrical chambers 51, 52, and 53 which are provided therein.

Slide bar 40 may be provided as a member of solid plastic, as shown, of a material such as polyethylene, polypropylene or a polymer of tetrachloroethylene such as Teflon, with chambers 51, 52, and 53 machined into the part, or may be made as an injection molding with chambers 51, 52, and 53 molded into the part or may be made as an assembly of pieces cemented together. Slide bar 40 may be made of metal. The wall portions 42, 44, 45, 46 and 47 of tube 43 are preferably made of stainless steel or other acceptable food grade material as will be discussed further hereinafter.

Slide bar 40 is further provided with agitator members or portions 54 and 55 which may be somewhat rounded as shown and which extend upward into the bulk of balls 14 to stir them as bar 40 is reciprocated slidingly in tube 43. Such agitation stirs the balls somewhat in order to prevent bridging of the balls over the chambers 51, 52 and 53 so that thereby a ball falls or is pushed by the other balls into each of these chambers relatively soon after a ball is removed from one of the chambers.

The reciprocating motion of slide bar 40 is achieved by rotation of knob 48 which is affixed to shaft 49 contained in coin mechanism 17.

Coin mechanism 17 is conventional and for simplicity its internal mechanism which may be contained in housing 25 is not shown. It provides a somewhat recessed coin slot 21 (FIG. 8) to receive a coin and provides means to accept or reject coins and provides for coins which are accepted to drop into coin box 9 as indicated in FIG. 5 for coin 8 which drops into open topped coin box 9 from the rear of housing 25.

Affixed to the end of shaft 49 opposite to knob 48 is crank 56 which is hingingly attached by crankpin 57 to connecting rod 58 which is hingingly attached at its opposite end 59 to pin 62 received in bar 40 and extending therefrom at 59. A portion of connecting rod 58 is provided to extend downward as indicated at **58*a*** to prevent improper operation as discussed below.

The path of crankpin 57 when knob 48 is rotated is indicated in FIGS. 5 and 6 by dashed arrows 63.

Located immediately below tube 43 and communicating therewith through openings 64 and 66 in the bottom wall 45 of tube 43 are secondary holding chambers 65 and 67.

Slide bar 40 is at its point of maximum travel in one direction in FIG. 4 and FIG. 5 as indicated by the positions of ends 71 and 72 of slide bar 40 in those figures and by the overlapping relation of crank 56 and connecting rod 58 in those figures.

Slide bar 40 is at its point of maximum travel in the other direction in FIG. 6 as indicated by the positions of ends 71 and 72 at 71' and 72' in that figure and by the extended in-line relation of crank 56 and connecting rod 58 as shown at 56' and 58'.

The chambers 51, 52 and 53 in slide bar 40 and secondary holding chambers 65 and 67 are so dimensioned that a ball contained in one of the chambers in slide bar 40, when passed over one of the secondary holding chambers will fall into it if it is empty and will pass over the secondary holding chamber if it has a ball in it. The ball in the upper chamber (in the slide bar) simply slides or glides over the ball in the lower chamber.

For purposes of explanation, if it is assumed that both secondary holding chambers are empty and the slide bar 40 is moved from its position shown in FIG. 5 to the position of FIG. 6, two of the chambers (51 and 52) in slide bar 40 will pass over chamber 65 and on the return stroke chamber 52 will again pass over chamber 65 thus providing three opportunities for a ball to fall into chamber 65 and ample agitation of the balls is provided by members 54 and 55, thereby assuring that chamber 65 will not remain empty after bar 40 has traveled through a full stroke. If a ball falls into chamber 65 at each of the three aforementioned opportunities and connecting rod 58 were not provided with downwardly extending portion **58*a*, it would be possible for a player to stop the rotation at each time chamber 65 became filled and operate knob 28 to eject the ball from the chamber as discussed below. By so doing the operator might improperly obtain more than one ball to play with the insertion of a single coin. However, by providing portion 58a this possibility is prevented and only one ball can be obtained upon one rotation of crank 56 and one full stroke of slide bar 40**.

Likewise, as slide bar 40 travels through a half stroke from its position in FIG. 5 to the position of FIG. 6, one of the chambers in bar 40, namely chamber 53, will pass over chamber 67 and on the return half stroke chamber 53 will again pass over chamber 67 thus providing two opportunities for a ball to fall into chamber 67 during a full stroke. With the agitation provided by members 54 and 55 it is thus assured that chamber 67 will be filled by the time bar 40 has completed a full stroke.

To initiate the process of dispensing a ball (or in more common language, to start playing the game) the user or player, after putting a coin into coin slot 21 (FIG. 8) of mechanism 17 to allow knob 48 to be turned and then turning knob 48 through a full 360 degrees of rotation to cause bar 40 to be reciprocated through a full stroke, pushes knob 28 as indicated by arrow 27 (FIG. 13) until knob 28 reaches the position shown at 28' so that spring 74 shown as being uncompressed in FIGS. 1, 2, 3, 4, 7, 9, and 11 is driven to the compressed state shown as 74' in FIG. 13 and pin 75 to which knob 28 is attached is driven forward to the position indicated at 75' in FIG. 13

Hole 73 is provided in secondary holding chamber 65 so that pin 75 may enter the chamber and push a ball out of the chamber, as shown in FIG. 13, where ball **14*a* (FIGS. 6, 11, 12, and 13, shown in phantom view in some of these figures) is being pushed against flap door 80 which normally closes the rear of secondary holding chamber 65 as shown at FIGS. 11 and 12**.

Door 80 is hingably mounted on horizontally extending hinge pin 81 and may be biased into the closed position indicated at 80 (FIG. 11) by the action of spiral torsion spring 82 mounted on pin 81 or by any equivalent spring actuated biasing mechanism. In the closed position door 80 provides a rear closure for chamber 65.

Figure 27:
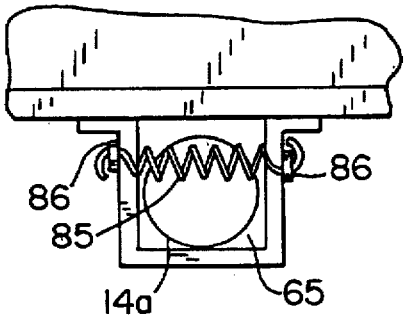
FIG. 27 is a view corresponding to FIG. 12 of a modification of the embodiment of FIG. 12.

Other means than door 80 may be provided to retain the ball in the secondary holding chamber in the event of the machine being tilted. Thus, as shown in FIG. 27, a modification of the embodiment of FIG. 12 is shown wherein a spring 85 is shown as extending horizontally across the rear opening of chamber 65, being held in place by support members 86 which may extend rearwardly from the sides of chamber 65 and may be provided with holes into which the ends of spring 85 are hooked. The pushing of knob 28 to push pin 75 against the ball may then force the ball against and past spring 85 as spring 85 is deflected by the ball in obvious manner not shown.

Figure 14:
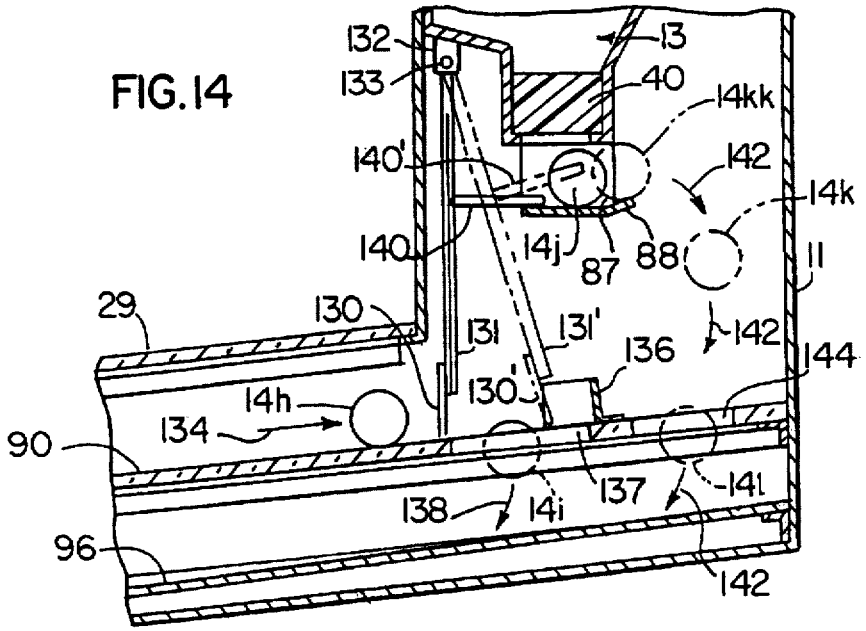
FIG. 14 is a cross sectional view taken on lines 14—14 in FIG. 7.

Other means to provide for retaining a ball in chamber 65 if the machine is tilted is shown in FIG. 14 wherein lip 88 is provided at the exit aperture of secondary holding chamber 67 so that the ball can only be made to leave the chamber by causing it to be pushed over lip 88 with pin 75. A similar lip can be provided at the rear of chamber 65 for the same purpose.

When pin 75 as shown at 75' pushes a ball in chamber 65 as shown at **14*a* (FIG. 13) against the door 80 to open it to the position shown at 14*b* the ball is ejected from the chamber so that it falls in the path indicated by arrow 76 onto playfield 90 as indicated at 14*c* whereupon it may roll downward on playfield 90 to any position on the field as indicated at 14*c***.

It may then encounter bumper or obstacle 91 which may be of any shape or material. Thus, while obstacle 91 is shown as being cylindrical and extending upwardly from playfield 90 to cover 29 it may be oval or elongated or square and although mounted on playfield 90 may not extend upwardly as far as cover 29. In one embodiment it may be transparent and in another it may be opaque.

Whether or not the ball encounters obstacle 91 it may encounter one of flippers 19 or the player may be able to so move one of flippers 19 by manually rotating the knob 18 which is attached thereto by a shaft passing through cover 29, that the flipper hits the ball and deflects it from its previous path.

If the ball is not delayed in its travels by one of these events it will sooner or later encounter hole 93 in playfield 90 and drop through that hole as indicated at **14*e* onto retrieval member 96 whereupon it will no longer be available for any play and will roll downward on retrieval member 96 until it reaches the position indicated at 14*f* in contact with the inner surface of door 16. The player can then obtain the ball by opening door 16** and letting the ball fall out into the player's hand.

Hole 93 may be made much larger and may be made to extend for the full width of the machine at the bottom of the playfield.

If the player is successful in causing one of flippers 19 to contact the ball he may be able, by suitable rotation of the flippers whose tips travel in arcs indicated by arrows 19', using knobs 18 which are attached to flippers by shafts to cause the rotation of the flippers, cause the ball to hit a target to cause another ball to be released as a prize in a manner hereinafter to be described.

Alternately, if the player is unsuccessful in this endeavor, the ball will in due course fall through one of holes 93, 94 and 95 in the playfield surface as indicated at **14*e* if falling through hole 93 or as indicated at hole 94, whereupon it rolls on retrieval member 96 to the dispensing position indicated at 14*f***.

Referring now to FIG. 14 there is provided a target member 130 which may be attached to an upwardly extending member 131 hingably supported from hinge member 132 so that it may hingedly swing on horizontal axis 133 to the position indicated at 130' and 131' when the player is successful in using the flippers to cause a ball as indicated at **14*h* to travel in the direction indicated by arrow 134 to thereby contact target 130 with sufficient force to drive it to the position shown at 130'**.

Stop member 136 may be provided extending upwardly from the playfield surface 90 to interrupt the backward swinging motion of members 130 and 131 so that they do not swing to an excessive degree. As these members swing backward, the ball which struck the target drops through hole 137 in playfield 90 as indicated at **14*i* whence it will fall onto retrieval member 96 as indicated by arrow 138**.

Pin 140 is attached to member 131 so that as target 130 is driven backward when struck by a ball, pin 140 is thrust into secondary receiving chamber 67 to push the ball which is being held in the chamber as indicated at **14*j* over lip 88 as discussed above with the ball being pushed to the position being shown at 14*kk* whereupon it may fall away from the chamber as indicated by arrows 142 through the positions indicated at 14*k* and and 14*l* through opening 144 in playfield member 90 onto retrieval surface 96. It may then be retrieved as a prize through door 16**.

Figure 16:
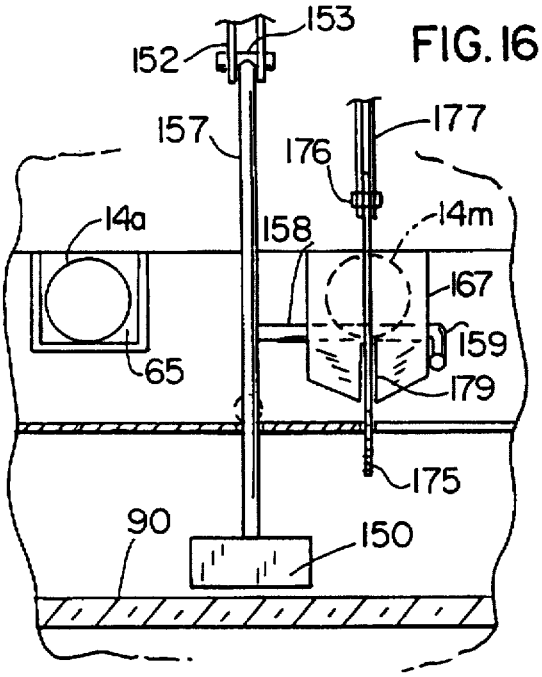
FIG. 16 is an elevation taken from the point of view of lines 16—16 in FIG. 15.
Figure 15:
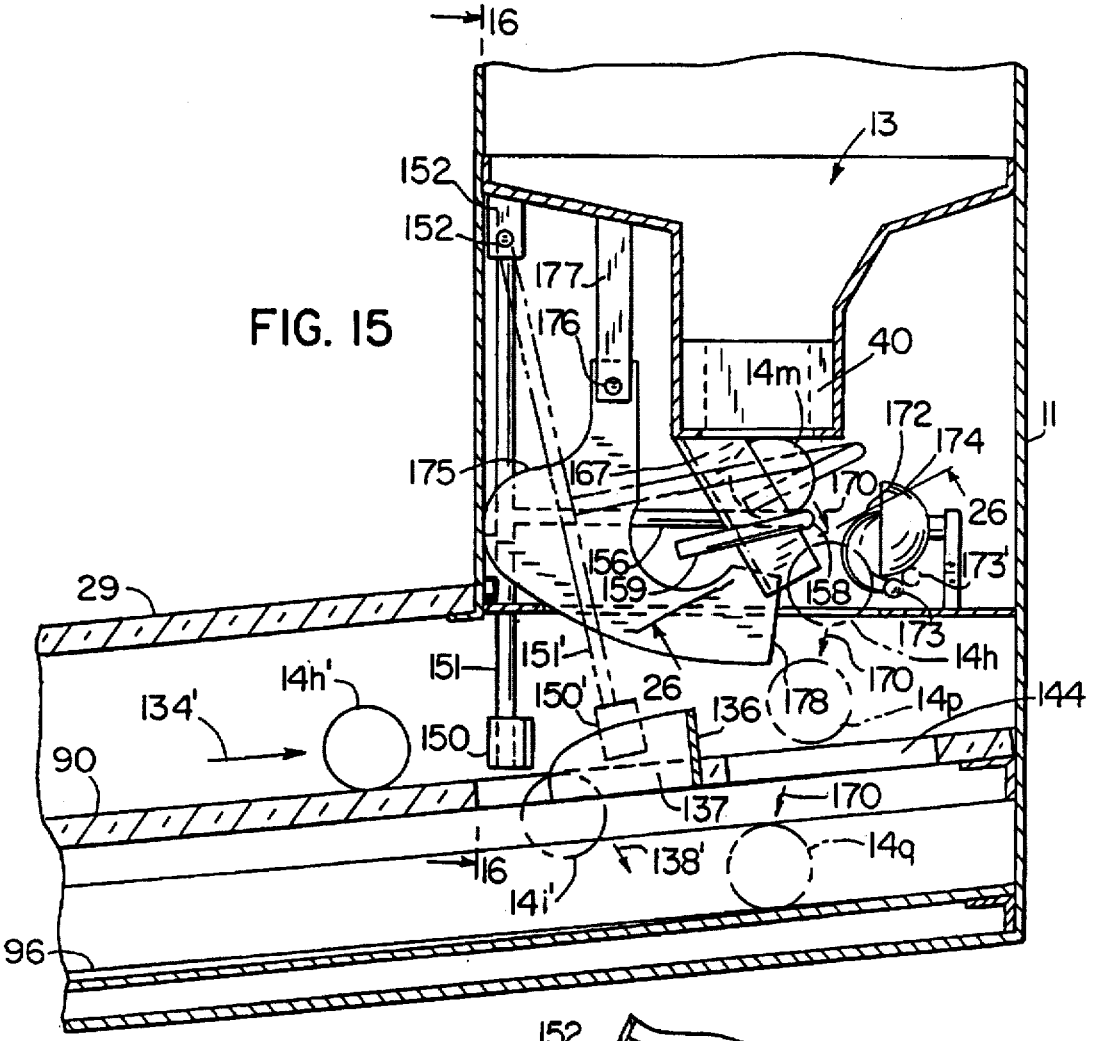
FIG. 15 is a partially cut away view of a modification of the embodiment of FIG. 14.

Referring now to FIG. 15 and FIG. 16 there is provided another embodiment which replaces secondary holding chamber 67 and target 130 in providing means to dispense a prize ball when a target is struck by the ball in play.

Target member 150 may be attached to an upwardly extending member 151 hingably supported from hinge member 152 so that it may hingedly swing on horizontal pin 153 to the position indicated at 150' and 151' when the player is successful in using the flippers to cause a ball as indicated at **14*h*' to travel in the direction indicated by arrow 134' to thereby contact target 150 with sufficient force to drive it to the position shown at 150'**.

Stop member 138' may be provided extending upward from playfield 90 to arrest the swinging motion of target 150 resulting from being struck by the ball. As an alternative, stop member 138' may be omitted and the action of the wire comprising parts 156, 157, and 158 in striking tube 43 which houses slide bar 40 may be relied upon to halt the swing of target 150 and its support member 151.

The ball after striking target 150 may fall through opening 137' in member 90 as indicated at **14*i*' whence it may fall onto retrieval member 96 as indicated by arrow 138'. As an alternative, hole 137'** may be omitted and the ball after striking the target may be allowed to roll back down the playfield and may again be put into play with the flippers. However unless other provisions are made, it cannot be utilized to obtain another prize since no action will have been taken to place another ball in position to be awarded as a prize.

To hold a ball in place below slide bar 40 as indicated at **14*m* there may be provided in place of secondary holding chamber 67, the combination of chute 167 and wire 156 attached to swingable support member 151 to extend beyond chute 167 and bent as shown to extend across chute 167 at 158 and then alongside the opposite side of chute 167 at 159**.

Figure 26:
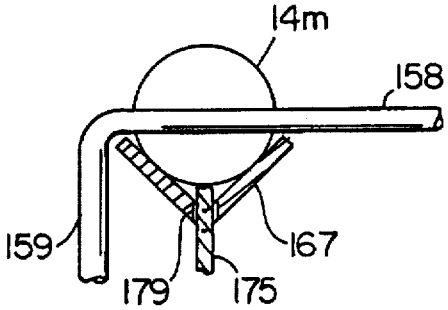
FIG. 26 is a cross sectional view taken on lines 26—26 in FIG. 15.

Chute 167 may have the configuration of two sides meeting at a 90 degree angle at the bottom as shown in FIG. 26.

When target 150 is struck and driven to the position at 150', wire 156 is moved to the position indicated at 156'.

158' and 159' thereby leaving ball 14*m* unimpeded so that it can and will fall as indicated by arrows 170 through the positions indicated at 14*n* and 14*p* through opening 144 onto retrieval member 96 as indicated at 14*q*.

While falling through the position indicated at 14*n* the ball may strike dapper support 172 to cause clapper 173 to strike and ring bell 174 as indicated at 173'. Similarly, the ball can be caused to strike switches to illuminate displays or to display other indicia as a result striking the target.

Figure 28:
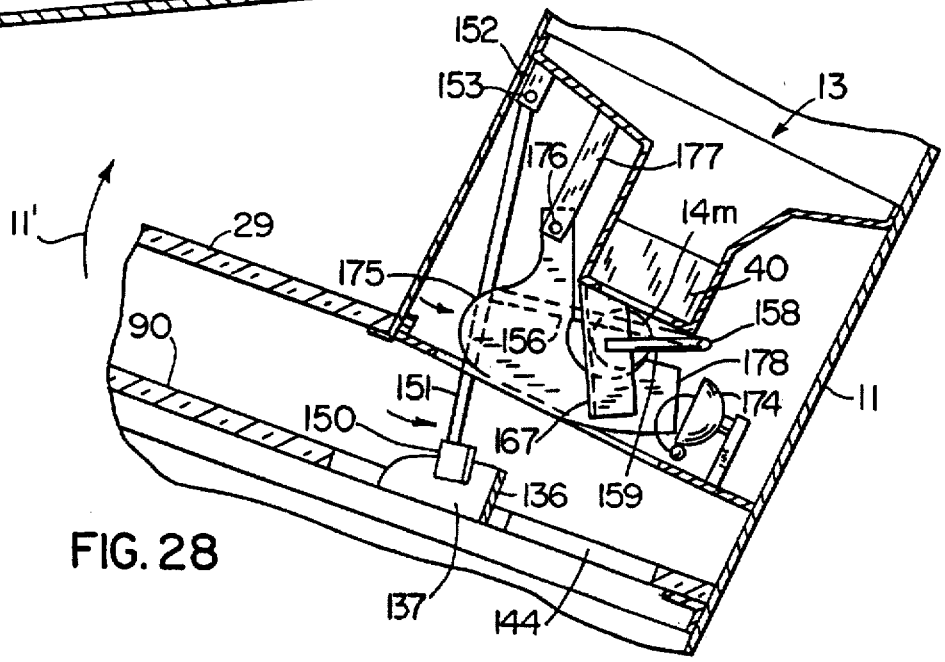
FIG. 28 is a view corresponding to FIG. 15 but with the main body of the machine tilted as indicated by arrow 11'.

Ref erring now to FIGS. 15 and 28, means are preferably provided to prevent an unwanted result of tilting the machine by raising its front end to a substantial extent as indicated by arrow 11'.

If no such means are provided, raising the front of the machine as indicated by arrow 11' (FIG. 28) will cause the target assembly comprising members 150, 151 and 156 to be moved by the force of gravity to the position indicated at 150', 151' and 156' whereby a ball in the position indicated at 14*m* will be dispensed and can be retrieved by the player in place of a prize even though no money was put into the machine and no game was played.

To prevent this result member 175 may be provided hingedly supported at 176 from support member 177 to hingably swing by gravity into the position indicated at 175 in FIG. 28 when the front of the machine is lifted.

The tip 178 of member 175 extends through slot 179 in chute 167 and when member 175 is in the position shown in FIG. 28, tip 178 is interposed against the bottom of ball 14*m* and thereby prevents ball 14*m* from moving.

Figure 17:
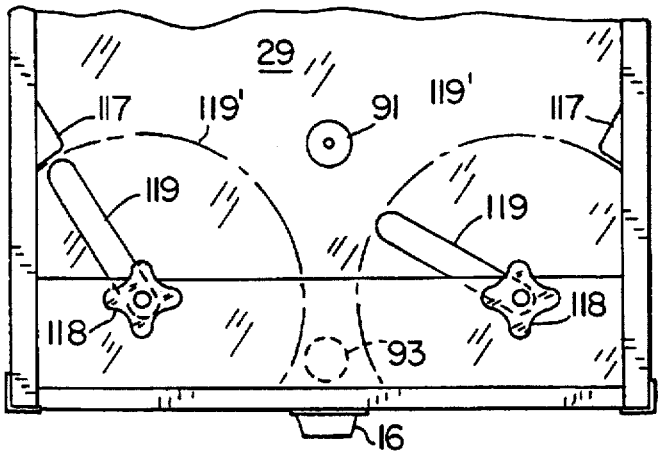
FIG. 17 is a plan view of a modification of the portion of the embodiment of FIG. 7 which includes the flippers.
Figure 18:
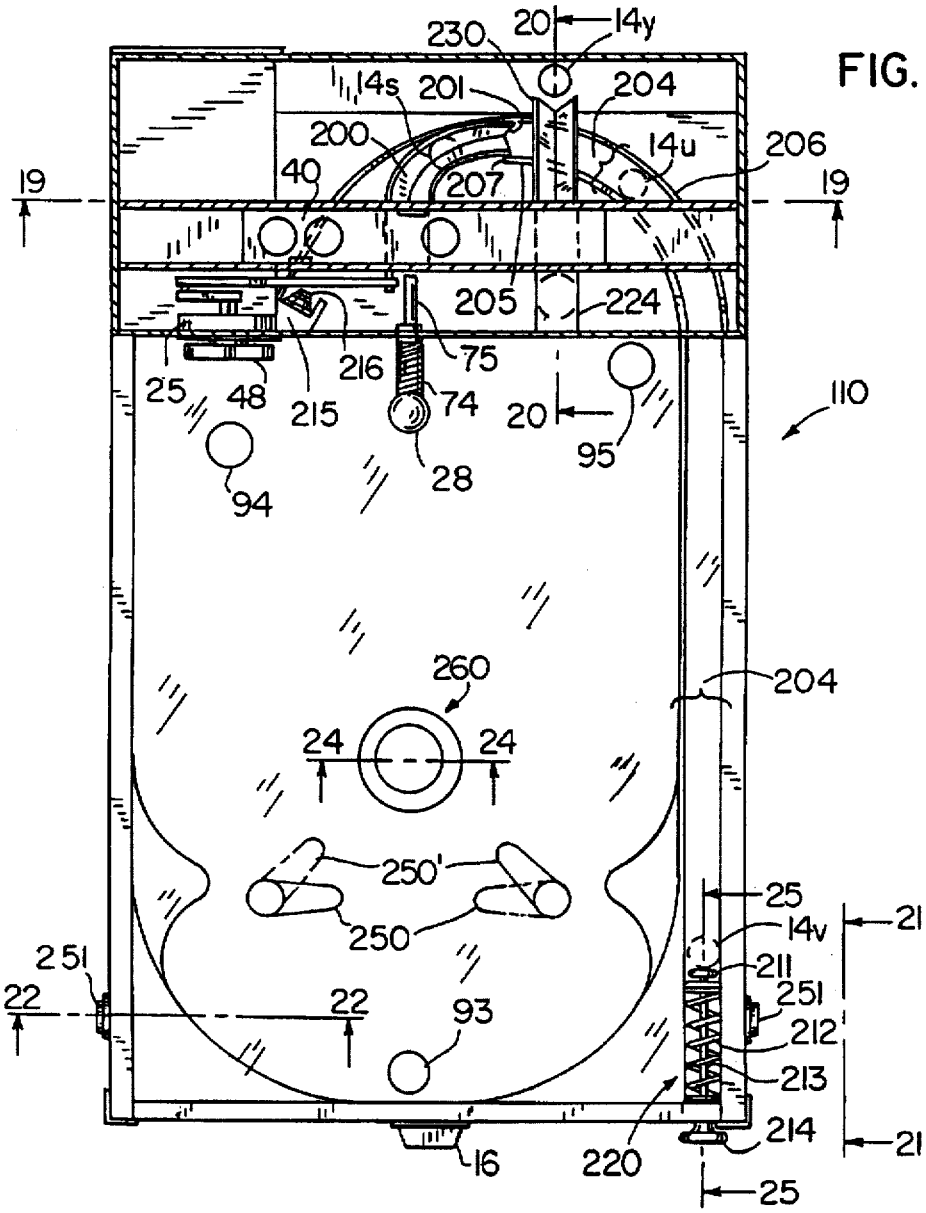
FIG. 18 is a plan view of another embodiment.
Figure 19:
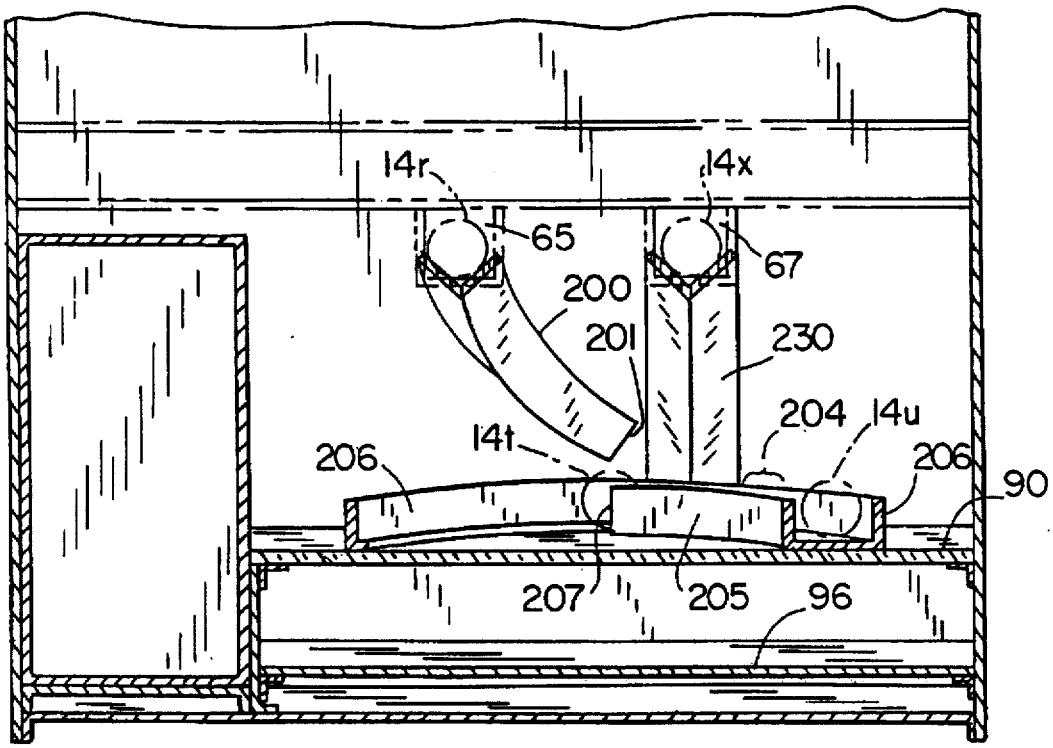
FIG. 19 is a cross sectional view taken on lines 19—19 in FIG. 18.

Referring now to FIG. 17, flippers 119 may be configured somewhat differently than flippers 19 and may be placed in positions to more nearly travel in a full circle as indicated by arrows 119' which show the paths of the tips of flippers 119 when knobs 118 are rotated. Guides 117 may be provided to direct balls onto the flippers and reduce the extent to which they may pass by the flippers.

Referring now to FIGS. 18, 19, 20, and 25, there is shown a modification of embodiment 10 which is indicated generally as 110 wherein the ball to be put in play (as indicated at 14*r*) is ejected from secondary holding chamber 65 by operation of knob 28 to cause pin 75 to push the ball out of that chamber and onto curvilinear chute 200 which may have a cross section such as that shown for chute 167 in FIG. 26 and may lead from the outlet of secondary holding chamber 65 so that the ball may roll down it as indicated at 14*s* and drop off the end 201 of chute 200 into driving channel 204 as indicated at 14*t*. Driving channel 204 may have inner wall 205 and outer wall 206. The ball may then roll down channel 204 as indicated at 14u and thence into contact with plunger driving head 211 as indicated at 14*v*.

Plunger driving head 211 may be connected through spring 213 by driving shaft 212 to driving knob 214 to provide the mechanism indicated generally as plunger assembly 220.

The game may then be begun in a manner which is conventional for pinball machines. When the plunger head 211 is withdrawn to the position shown at 211' by pulling knob 214 to the position shown at 214', spring 213 is compressed in a manner which for simplicity is not shown. When knob 214 is then released the ball is driven up channel 204 in conventional manner by the energy stored in the spring.

If driven strongly enough the ball will follow outer wall 206 around the top of the playfield until it hits the rebound spring 216 mounted in support member 215 at the end of channel 204. The ball will then bounce back and roll down playfield surface 90.

If the ball is driven less strongly it will have insufficient centrifugal force to hold it against outer wall 206 and will leave that wall and and follow inner wall 205 until it passes the end 207 of wall 205 and rolls onto playfield 90 between wall-end 207 and spring 216.

In either event once the bar rolls onto play field 90 it may be possible for the player to engage it with one or both of flippers 250 and the player may then be able to cause the ball to enter a target area as indicated at 14*w* before it passes through any of the holes provided in playfield 90 as hereinbefore described.

Playfield 90 may be of glass or transparent plastic. Retrieval member 96 is preferably opaque and may be of stainless steel or other suitable rigid material.

The target area in this embodiment may be the area below micro-switch 222 which may be mounted as shown above playfield surface 90 so that if the ball enters the area it actuates switch 222 as shown at 14*w*. Graphics, not shown, may identify the target area. The ball may then fall through opening 137 in playfield 90 onto retrieval member 96 as indicated by arrow 223.

Actuation of switch 222 may provide current to actuate solenoid 224 to drive prize ball drive member 225 into the position shown at 226 to drive prize ball held in chamber 67 as indicated at 14*x* therefrom onto chute 230 which may have a cross section like that of chute 167 as shown in FIG. 26. The ball may roll downward in chute 230 and pass therefrom as indicated by arrow 231 into contact with the back wall as indicated at 14*y* and thence may ricochet as indicated by arrow 232 onto retrieval surface 96.

Figure 20:
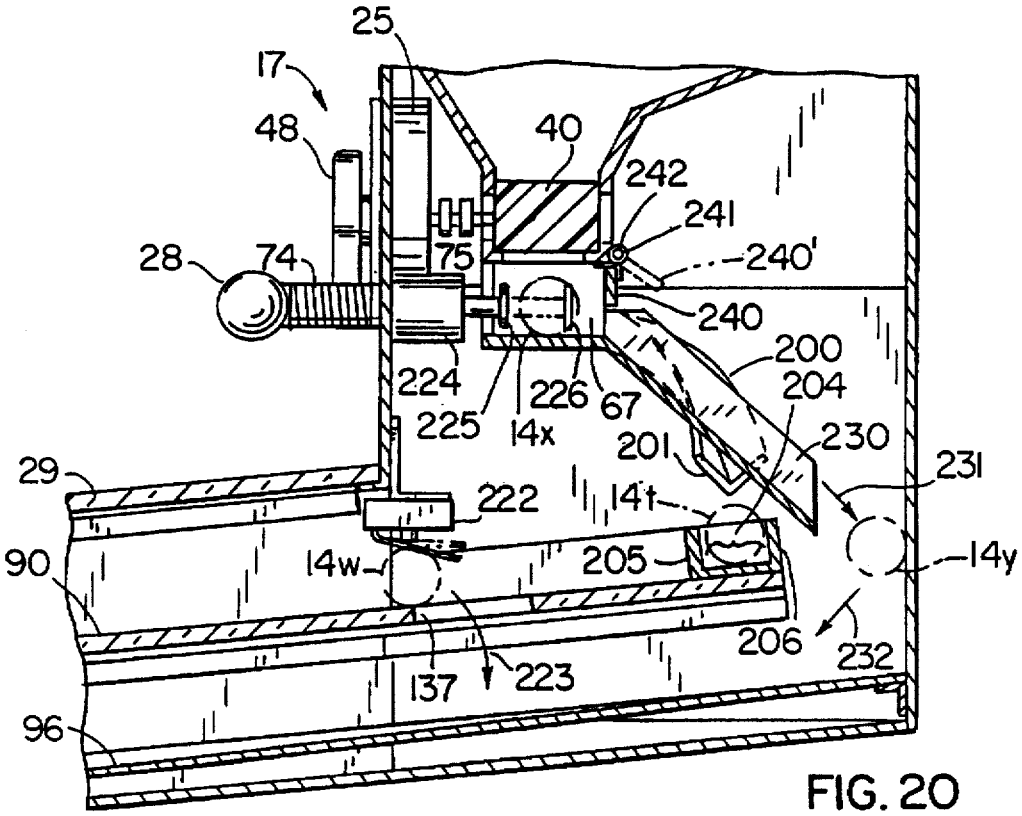
FIG. 20 is a cross sectional view taken on lines 20—20 in FIG. 18.

A partial door 240, mounted to hingedly open on horizontal axis 241 and biased into the closed position by torsion spring 242 mounted in the same manner as spring 82 is mounted to hold door 80 closed (FIG. 12) may be provided to partially close the outlet of secondary holding chamber 67 as shown in FIG. 20. Partial door 240 serves to retain a ball in chamber 67 as indicated at 14*x*, no matter how much the machine may be tilted in any direction. When solenoid 224 is activated to drive member 225 far enough so that it reaches the position indicated at 226 it is sufficiently displaced to drive the ball against the door with sufficient force to open it and then with sufficient force and far enough out of the chamber to open partial door 240 to the degree shown at 240' whereby the action of member 226 ejects the ball from the chamber past the door.

As shown in FIGS. 18, 21, 22, and 23 flippers 250 may be provided to be electrically operated by pressing flipper switch buttons 251 to close flipper switches 252 to activate solenoid units 254 which may be mounted to the underside of playfield member 90. Each of flippers 250 may be fixedly attached to a shaft 259 which may be received in a mounting member 258 attached to playfield member 90 and may extend therethrough normal thereto and have a crank member 257 fixedly attached to its lower end. The outer end of each of crank members 257 may be pin connected or otherwise hingedly connected at 256 to reciprocating operating members 255 extending from each of solenoid units 254.

When units 254 are activated, members 255 may be withdrawn thereinto against the force applied by springs 253 whereby through the action of crank members 257 the flippers are moved into the activated positions indicated at 250'.

When units 254 are deactivated the force of springs 253 will cause the flippers to be returned to their un-activated positions as indicated at 250.

As shown in FIG. 24 an electrically operated bumper indicated generally as 260 may be provided in place of obstacle 91. Bumper 260 may comprise solenoid unit 262 which may be mounted to playfield member 90, to extend therethrough, by rubber mounting member 264. Armature member 265 may extend through solenoid unit 262 and be provided with a head portion 266 on its upper end and a head portion 267 on its lower end. Surrounding spacer member 269, which may be received on armature 265, there may be a hollow annular member 270 of resilient rubber which may contain a gas such as air or nitrogen. Engaged with the upper surface of member 270 there may be provided washerlike driver member 268 which may be received on member 265 and retained thereon by engagement with head 266.

When a ball as indicated at **14*aa* comes in contact with member 270 it may also be in contact or nearly in contact with the outer somewhat upwardly flared portion of washerlike driver member 268. The force of the ball against member 270 may increase the pressure of the gas contained therein to a slight degree and means not shown may be provided to detect this slight increase in gas pressure and cause a switch not shown to be closed to activate solenoid unit 262 to cause members 268 and 267 to be quickly moved to the positions shown at 268' and 267'**.

The action of the flared portion of member 268 when moved suddenly downward against the ball is to very quickly move it by a "squeezing" action to the position indicated at **14*z*** while giving it considerable momentum due to the rapidity of acceleration provided to thereby cause it to move rapidly away from the bumper.

Whereas certain materials have been referred to above as being preferred for various parts of the machine, it is to be understood that all parts which come into the slightest contact with any of the balls are preferably to be made to "food-grade" standards as defined by pertinent regulations by all government agencies concerned since although the machine may be used for inedible objects such as rubber balls it is designed and intended for use with spherical or near-spherical objects such as gumballs and hard candy balls which may be introduced into the mouth or ingested.

The details of the machine disclosed herein may be varied substantially without departing from the spirit of the invention or the scope of the claims and the exclusive use of such modifications as come within the scope of the claims and equivalents thereof is envisioned.

What is claimed is:

1. A machine which comprises the combination of a reservoir to contain balls, a sloping playfield containing at least one hole large enough to allow passage of one of said balls downward therethrough, a sloping dispensing surface disposed below said playfield combined with a dispensing outlet so that balls which fall onto said dispensing surface roll to said dispensing outlet, actuatable target means associated with said playfield, a coin mechanism, two flippers mounted to make contact with a ball drooped onto said playfield to roll the ball on said playfield in order to attempt to cause the ball to actuate said target, characterized by a separator to separate substantially simultaneously at least two balls from the reminder of balls in said reservoir, means to cause just one of the two balls separated by said separator to drop onto said playfield, release means associated with the tract to release a second ball from said separator onto said dispensing surface, means associated with the target to cause a ball which actuates the target to leave the playfield and drop onto the dispensing surface.

2. The combination of claim 1 wherein said separator comprises a horizontally reciprocating slide bar, said slide bar being provided with agitator means extending upwardly into the bulk of the balls in the reservoir in order to prevent bridging of the balls, further characterized by at least two chambers contained in said reciprocating slide bar and communication with said reservoir to receive balls moving by gravity downwardly thereinto to substantially simultaneously separate said balls from the bulk of balls in the reservoir, said slide bar having associated means comprising a secondary chamber to receive a ball which moves downwardly by force of gravity from one of said chambers in said slide bar, said secondary chamber being provided with exit-preventing means to prevent exit of an article from the chamber, and means to make said exit-preventing means ineffective in order to thereby cause said ball to fall onto said dispensing surface.

3. The combination of claim 2 wherein said balls are balls of rubberlike material.

4. The combination of claim 2 wherein said balls are balls of hard candy.

5. The combination of claim 2 wherein said balls are gumballs.

6. The combination of claim 1 wherein said balls are balls of rubberlike material.

7. The combination of claim 1 wherein said balls are balls of hard candy.

8. The combination of claim 1 wherein said balls are gumballs.

* * * * *